US012800231B2

(12) United States Patent
Averous et al.

(10) Patent No.: US 12,800,231 B2
(45) Date of Patent: Nov. 17, 2026

(54) BRAZED PLATE HEAT EXCHANGER WITH SEALED COMPARTMENTS CAPABLE OF LOCAL DEFORMATION

(71) Applicant: ALFA LAVAL GOLBEY SAS, Golbey (FR)

(72) Inventors: David Averous, Golbey (FR); Laurent Claudel, Golbey (FR); Isabelle Naude, Golbey (FR); Julien Hirt, Golbey (FR); Thibault Reignier, Golbey (FR)

(73) Assignee: ALFA LAVAL GOLBEY SAS, Golbey (FR)

( * ) Notice: Subject to any disclaimer, the term of this patent is extended or adjusted under 35 U.S.C. 154(b) by 0 days.

(21) Appl. No.: 18/725,276

(22) PCT Filed: Dec. 12, 2022

(86) PCT No.: PCT/EP2022/085326
§ 371 (c)(1),
(2) Date: Jun. 28, 2024

(87) PCT Pub. No.: WO2023/126163
PCT Pub. Date: Jul. 6, 2023

(65) Prior Publication Data

US 2025/0129992 A1 Apr. 24, 2025

(30) Foreign Application Priority Data

Dec. 30, 2021 (FR) ..... FR2114689

(51) Int. Cl.
*F28D 7/16* (2006.01)
*F28D 9/00* (2006.01)
(Continued)

(52) U.S. Cl.
CPC ..... *F28D 9/0062* (2013.01); *F28D 7/16* (2013.01); *F28F 3/025* (2013.01); *F28F 9/02* (2013.01);
(Continued)

(58) Field of Classification Search
CPC ... B23K 2101/14; B23K 31/003; B23P 15/26; F28D 7/16; F28D 9/0062;
(Continued)

(56) References Cited

U.S. PATENT DOCUMENTS 6,893,619 B1 * 5/2005 James ..... F28D 9/005 422/615
2010/0181053 A1 * 7/2010 Hecht ..... F25J 5/005 165/164
(Continued)

FOREIGN PATENT DOCUMENTS

EP 2829715 A1 1/2015
EP 3121550 A1 1/2017
(Continued)

OTHER PUBLICATIONS

International Search Report of PCT/EP2022/085326, Issued on Jul. 6, 2023.
(Continued)

*Primary Examiner* — Eric S Ruppert
*Assistant Examiner* — Hans R Weiland
(74) *Attorney, Agent, or Firm* — The Belles Group, P.C.

(57) ABSTRACT

A heat exchanger comprising a body and at least one dispensing or collection head is disclosed. The body comprises a plurality of compartments in which a fluid is capable of flowing, at least one sealed compartment, and separating walls disposed between the compartments and intended to hermetically separate the compartments from one another. The at least one dispensing or collection head is configured
(Continued)

to distribute a fluid into the plurality of compartments or collect the fluid exiting the plurality of compartments, wherein the dispensing or collection head is secured to the body by a welding operation, and wherein the at least one sealed compartment is capable of deformation following the welding operation.

20 Claims, 1 Drawing Sheet

(51) Int. Cl.
*F28F 3/02* (2006.01)
*F28F 9/02* (2006.01)

(52) U.S. Cl.
CPC ..... *F28F 9/0219* (2013.01); *F28F 2265/26* (2013.01); *F28F 2270/02* (2013.01); *F28F 2275/06* (2013.01)

(58) Field of Classification Search
CPC . F28D 2021/0022; F28F 3/025; F28F 9/0062; F28F 9/02; F28F 9/0219; F28F 9/0221; F28F 9/0224; F28F 9/0239; F28F 2225/04; F28F 2265/26; F28F 2270/02; F28F 2275/04; F28F 2275/06; F28F 2280/08
See application file for complete search history.

(56) References Cited

U.S. PATENT DOCUMENTS

| | | | | |
|---|---|---|---|---|
| 2014/0343175 | A1* | 11/2014 | Saxton, Jr. | B01J 8/008 518/715 |
| 2016/0001256 | A1* | 1/2016 | Fujita | F28D 9/0062 422/198 |
| 2017/0108284 | A1* | 4/2017 | Fujita | F28F 3/025 |
| 2017/0131042 | A1* | 5/2017 | Fujita | F28F 9/0219 |
| 2019/0285363 | A1* | 9/2019 | Ruiz | B33Y 80/00 |

FOREIGN PATENT DOCUMENTS

| | | | | |
|---|---|---|---|---|
| EP | 3454000 | A1 * | 3/2019 | F28D 9/0062 |
| EP | 3524913 | A1 | 8/2019 | |
| JP | H03-096589 | U | 10/1991 | |
| JP | H05-030699 | U | 4/1993 | |
| JP | 2011-080750 | A | 4/2011 | |
| JP | 2015-183905 | A | 10/2015 | |

OTHER PUBLICATIONS

Office Action issued for the concurrent Chinese Application No. 202280086844.5; issued on Jul. 30, 2026.
Office Action issued for the concurrent Japan Application No. 2024-539981; issued on Jul. 21, 2026.

* cited by examiner

[Fig. 1]
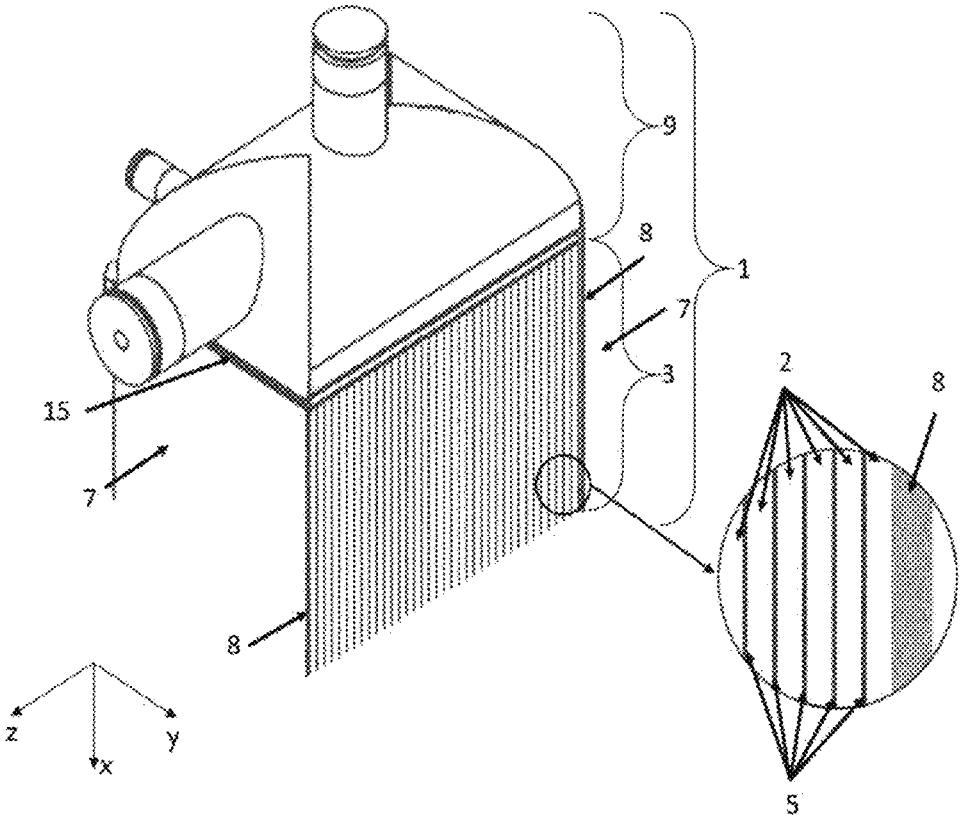
[Fig. 2]
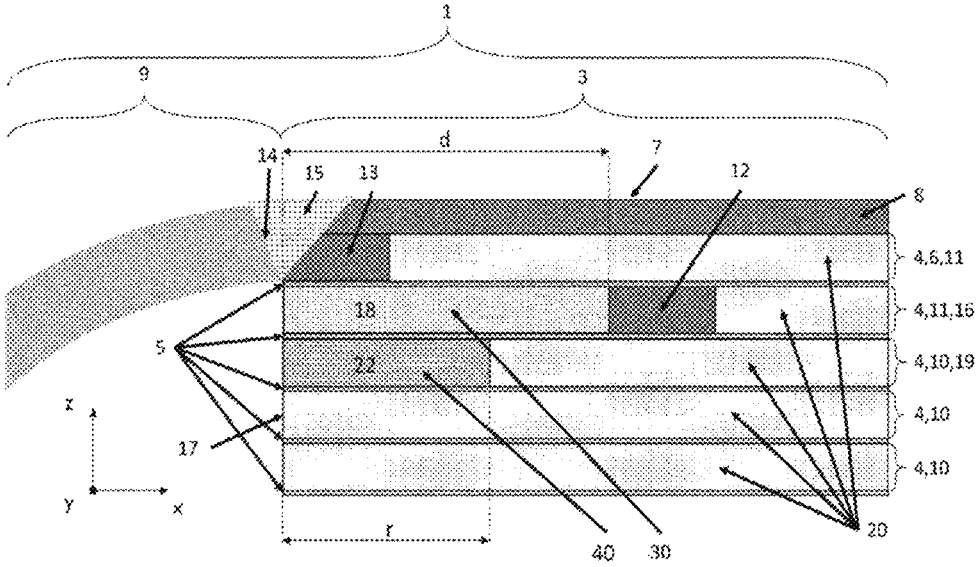

BRAZED PLATE HEAT EXCHANGER WITH SEALED COMPARTMENTS CAPABLE OF LOCAL DEFORMATION

CROSS-REFERENCE TO RELATED APPLICATIONS

The present application is a U.S. national stage application under 35 U.S.C. § 371 of PCT Application No. PCT/EP2022/085326 filed Dec. 12, 2022, which claims priority to French Patent Application No. 2114689 filed Dec. 30, 2021, the entire disclosures of which are incorporated herein by reference.

FIELD OF THE INVENTION

The invention belongs to the technical field of heat exchangers. The invention relates more specifically to plate heat exchangers filled with a powder designed to initiate a physical/chemical reaction.

TECHNICAL BACKGROUND

Brazed-plate heat exchangers are traditionally used in the cryogenic industry for gas separation and liquefaction, in the energy and petrochemical sectors.

As part of an energy transition with major CO2 emission reduction targets, many countries are showing increasing interest in new energy sources. In this context, brazed-plate heat exchangers are being adapted to new industrial-scale processes. This is the case for hydrogen liquefaction processes linked to the development of hydrogen mobility.

Hydrogen, for example, is more stable at low temperatures in the para hydrogen state than in the ortho hydrogen state. At low temperatures, particularly liquefaction temperatures, ortho hydrogen tends to spontaneously transform into para hydrogen, releasing unwanted heat.

To keep hydrogen in its liquid state, there are two options. A first option is to continuously extract the heat released by the conversion of ortho hydrogen into para hydrogen. In practice, this technique proves to be particularly energy-intensive, and uneconomical on an industrial scale.

A second option is to eliminate ortho hydrogen by converting it to para hydrogen. An exothermic catalytic reaction combined with cooling converts most of the ortho hydrogen into para hydrogen. Spontaneous conversions of ortho hydrogen to para hydrogen are then reduced.

This second option is one of the areas wherein the present invention can be applied.

Due to the use of a catalyst, often in powder form, inserted into the heat exchanger after the brazing operations, it is necessary to use hydrogen dispensing heads with large openings whose cross-section is substantially equal to that of said heat exchanger. This ensures even powder distribution in the exchanger compartments.

This means that the dispensing heads are particularly large, which has an impact on the heat exchanger.

Conventional heat exchangers typically comprise longitudinal and end bars defining compartments separated from each other by hermetic separating walls.

In the case of distributor heads whose cross-section is roughly equal to the cross-section of the heat exchanger, there are no end bars in catalyst-containing compartments, as they would impede the insertion of catalyst in powder form. However, the overall structure of the heat exchanger is weakened, as the end bars contribute to the mechanical strength of the heat exchanger and to the distribution of welding stresses.

During the assembly operation, the dispensing heads are welded to said heat exchanger. Weld cooling, material expansion, and material contraction cause mechanical stresses that can deform the main structure of the heat exchanger, reducing its efficiency. A further disadvantage is that these deformations make it more difficult to fill the heat exchanger with powdered catalyst, leading to maldistribution of the catalyst, which is detrimental to the unit's performance.

The invention aims to address these drawbacks.

SUMMARY OF THE INVENTION

For this purpose, a heat exchanger comprising:

a body provided with a plurality of compartments wherein a fluid is capable of flowing, and at least one sealed compartment, and separating walls disposed between the compartments and intended to hermetically separate the compartments from one another, at least one dispensing or collection head, for distributing a fluid into the compartments or for collecting the fluid exiting said compartments, wherein heat exchanger the dispensing or collection head is secured to the body by a welding operation and wherein said at least one sealed compartment is capable of deformation following the welding operation.

Such a heat exchanger enables the exchanger structure to absorb the mechanical stresses inherent in cooling the weld. This makes it easier to fill with powder.

Various additional features can be provided alone or in combination:

the heat exchanger comprises an end closure bar arranged inside an end compartment, said end closure bar being able to block the entry of a fluid into the end compartment, wherein the weld is made in an orifice delimited laterally on one side by the dispensing head and on the other side by the end closure bar;

the heat exchanger comprises an at least partially deformable compartment, said compartment being adjacent to the end compartment;

the deformable compartment comprises a deformable zone capable of being deformed;

the deformable zone extends from the inlet of the body over a minimum distance of 3 centimeters, measured in a longitudinal direction of the body;

the body comprises a reinforcement compartment wherein a fluid can circulate, adjacent to the deformable compartment;

deformable wave plates defining fluid flow channels are arranged in the deformable zone of the deformable compartment, and reinforcement wave plates defining fluid flow channels are arranged in the reinforcement compartment, the wave plates of the deformable compartment having a critical buckling load lower than the critical buckling load of the reinforcement wave plates;

the reinforcement wave plates are arranged in a reinforced zone of the reinforcement compartment, said reinforced zone extending over a distance measured from the inlet of the body over a minimum distance of 3 centimeters, measured in a longitudinal direction of the body;

the cross-section of the dispensing or collection head is substantially equal to the cross-section of the body;

the body contains a powder intended to initiate a physical/chemical reaction;

the powder is arranged in compartments wherein a fluid can circulate.

BRIEF DESCRIPTION OF THE FIGURES

Further features and advantages of the invention will become apparent from the following detailed description, which can be understood with reference to the accompanying drawings, wherein:

FIG. 1 is a schematic perspective representation of a portion of a heat exchanger according to the invention.

FIG. 2 is a schematic representation of a cross-section of the heat exchanger according to the invention.

DETAILED DESCRIPTION OF THE INVENTION

FIG. 1 shows a heat exchanger 1 according to the invention. Firstly, a longitudinal axis X is defined, extending along a length of the heat exchanger 1 corresponding to its largest dimension. Secondly, a first transverse axis Y is defined, substantially perpendicular to the longitudinal axis X and extending along a width of the heat exchanger 1. The X and Y axes form the plane XY. Finally, a third transverse axis Z is defined, substantially perpendicular to the X and Y axes, and extending along the height of the heat exchanger 1. The Z axis forms the plane ZX with the X axis, and the plane ZY with the Y axis.

The heat exchanger 1 comprises several longitudinal bars 2 together defining a body 3 provided with compartments 4 wherein a fluid is able to circulate. Each compartment 4 is bordered laterally along the Y axis by a longitudinal bar 2. The compartments 4 are adjacent to each other. In other words, compartments 4 are juxtaposed one on top of the other.

The heat exchanger 1 comprises separating walls 5. A separating wall 5 is located between each compartment 4. Thus, a separating wall 5 separates the compartments 4 from each other along the Z axis.

On either side of the heat exchanger 1 along the Z axis, the heat exchanger comprises an end compartment 6 located at the transverse ends 7. A closing wall 8 is arranged on each end compartment 6, thus closing the heat exchanger 1.

As shown in FIG. 1, the heat exchanger 1 comprises a fluid dispensing head 9 located at an inlet 17 of the heat exchanger 1. The dispensing head 9 has a cross-section, in the ZY plane, substantially equal to that of the body 3 of the heat exchanger 1.

The fluid thus distributed by the dispensing head 9 is distributed into the accessible compartments 4 arranged along the Z axis.

The heat exchanger 1 further comprises a collection head, not shown in the drawings, arranged opposite the dispensing head 9. The collection head collects the fluid leaving the compartments.

With reference to FIG. 2, the heat exchanger 1 comprises open compartments 10 wherein the fluid can circulate and compartments 11 closed by a bar 12, 13 wherein the fluid cannot, at least in part, circulate.

The compartments 11 are sealed off so as to prevent, at least in part, the circulation of fluid in them. Advantageously, a sealed-off compartment 11 is sealed by means of a transverse closure bar 12, 13 extending along the Y axis.

The dispensing head 9 is attached to the body 3 by welding. When the welding is complete, the cooling of a metal 15 causes mechanical stresses on the body 3. These mechanical stresses are commonly referred to as "material shrinkage".

Advantageously, at least one of the sealed-off compartments 11 is, at least in part, deformable. The deformable 11 compartment thus absorbs the mechanical stress caused by the welding operation. The structure of heat exchanger 1 is not damaged. In the following, reference is made to the deformable sealed-off compartment 11, for each adjacent compartment 16.

Advantageously, the heat exchanger 1 comprises an end closure bar 13, extending along the Y axis and arranged inside the end compartment 6. The end closure bar 13 is arranged at the inlet 17 of the end compartment 6. The end closure bar 13 thus blocks fluid entry into the end compartment 6.

Advantageously, the end closure bar 13 is beveled on its part facing the dispensing head 9. The end closure bar 13 thus defines an orifice 14 with the dispensing head 9. The orifice 14 is delimited laterally by the dispensing head 9 on one side and by the end closure bar 13 on the other. The weld is made in the orifice 14. In other words, the weld metal 15 is deposited in the orifice 14.

The end closure bar 13, in addition to acting as a support for the weld metal 15, prevents significant deformation of the end compartment 6. Indeed, deformation of the end compartment 6 would tend to weaken the dispensing head 9 or the collection head.

Advantageously, the body 3 comprises an adjacent compartment 16 which is at least partially deformable. The compartment 16 is enclosed and adjacent to the end compartment 6. As can be seen in FIG. 2, the adjacent compartment 16 is adjacent to the end compartment 6 along the Z axis. As a result of the material shrinkage after the welding operation, the adjacent compartment 16 deforms. In other words, the cross-section of the adjacent compartment 16 is reduced as a result of the welding operation. This deformation of the adjacent compartment 16 makes it possible to absorb the mechanical stresses due to material shrinkage, thus preserving the integrity of the heat exchanger 1. In particular, this prevents the weld from deteriorating, leading to unwanted leakage.

Advantageously, the adjacent compartment 16 comprises a closure bar 12 designed to block the passage of fluid.

The body 3 of the heat exchanger 1 comprises a deformable zone 18. The deformable zone 18 of the adjacent compartment 16 is the part of said adjacent compartment 16 that deforms under the effect of the stresses generated by the welding operation.

The deformable zone 18, thus localized, maintains the integrity of the heat exchanger 1 following material shrinkage.

The deformable zone 18 extends from the inlet 17 over a distance d measured along the X axis. Advantageously, the distance d is at least 3 centimeters.

Advantageously, the body 3 of the heat exchanger 1 comprises a reinforcement compartment 19. The reinforcement compartment 19 is located adjacent to the deformable compartment 16. The reinforcement compartment 19 is open, so fluid can flow through it. The reinforcement compartment 19 stops the deformation of the deformable zone 18 in order to prevent the cross-section of other open compartments 10 from being reduced. At the end of the welding operation, the reinforcement compartment 19 does not deform significantly.

Advantageously, the body 3 comprises wave plates 20. The wave plates 20 define circulation channels wherein the fluid can flow. The wave plates 20 are arranged in the open compartments 10 and in the closed compartments 11.

In the open compartments 10, the wave plates 20 guide the fluid through the channels. In the case of the catalytic heat exchangers 1, the channels are filled with a catalytic agent, usually in powder form. The fluid passes through the channels, and therefore through the powder acting as a catalyst.

In the closed compartments 11, the wave plates 20 act as a "deformable damper". In this way, they impart a certain resistance to stress to these sealed compartments 11 to prevent them from deforming too easily during various operations such as brazing or welding.

Advantageously, deformable wave plates 30 defining fluid circulation channels are arranged in the deformable zone 18 of the deformable compartment 16. Reinforcement wave plates 40, defining fluid circulation channels, are arranged in a reinforced zone 22 of the reinforcement compartment 19. The wave plates 30 in the deformable compartment 16 have a lower critical buckling load than the reinforcement wave plates 40. This makes it possible to locate the deformable zone 18. Thus, it is the deformable zone 18 that will deform after the welding operation, while the reinforced zone 22 will not deform significantly. In this way, the deformation can be controlled by focusing it on a desired point deemed to be safe for the heat exchanger. The deformation is not random. By deformation, we mean that the deformable zone 18 deforms elastically and is held in an elastically deformed position by the weld 15. The deformation is therefore not ductile and irreversible.

Advantageously, the reinforced zone 22 extends over a distance r measured along the X axis from the inlet 17. The distance r is at least 3 centimeters. A reinforced zone 22 with these dimensions strengthens the heat exchanger and prevents deformation of other open compartments 10 located below the reinforcement compartment 19.

The invention claimed is:

1. A heat exchanger, comprising:

a body provided with a plurality of compartments wherein a fluid can flow, and at least one sealed compartment, and separating walls disposed between the compartments and intended to hermetically separate the compartments from one another, wherein said compartments comprise an end compartment, at least one dispensing or collection head for distributing the fluid into the compartments via an inlet or for collecting the fluid exiting said compartments, wherein the dispensing or collection head is secured to the body by a welding operation, and wherein said at least one sealed compartment is capable of deformation following the welding operation, and an end closure bar arranged inside the end compartment, the end closure bar being able to block the entry of the fluid into the end compartment, wherein the weld is made in an orifice delimited laterally on one side by the dispensing head and on the other side by the end closure bar.

2. The heat exchanger according to claim 1, further comprising an at least partially deformable compartment, said deformable compartment being adjacent to the end compartment.

3. The heat exchanger according to claim 2, wherein the deformable compartment comprises a deformable zone capable of being deformed.

4. The heat exchanger according to claim 3, wherein the deformable zone extends from the inlet of the body over a distance of at least 3 centimeters, measured in a longitudinal direction of the body.

5. The heat exchanger according to claim 2, wherein the body comprises a reinforcement compartment, wherein the fluid is able to flow, adjacent to the deformable compartment.

6. The heat exchanger according to claim 5, wherein deformable wave plates defining fluid flow channels are arranged in the deformable zone of the deformable compartment, and reinforcement wave plates defining fluid flow channels are arranged in the reinforcement compartment, the wave plates of the deformable compartment having a critical buckling load lower than the critical buckling load of the reinforcement wave plates.

7. The heat exchanger according to claim 6, wherein the reinforcement wave plates are arranged in a reinforced zone of the reinforcement compartment, said reinforced zone extending over a distance measured from an inlet of the body over a minimum distance of 3 centimeters, measured in a longitudinal direction of the body.

8. The heat exchanger according to claim 1, wherein the cross-section of the dispensing or collection head is substantially equal to the cross-section of the body.

9. The heat exchanger according to claim 1, wherein the body contains a powder intended to initiate a physical/chemical reaction.

10. The heat exchanger according to claim 9, wherein the powder is arranged in the compartments wherein the fluid is able to circulate.

11. A heat exchanger for receiving a fluid, comprising:

a body, comprising:

a first compartment through which the fluid can flow;

a second compartment through which the fluid can flow, wherein the second compartment comprises reinforcement wave plates;

a sealed compartment comprising deformable wave plates, wherein the deformable wave plates have a critical buckling load that is lower than a critical buckling load of the reinforcement wave plates; and a separating wall disposed between the first compartment and the second compartment that hermetically separates the first compartment and the second compartment from one another; and a dispensing head for distributing the fluid into the first compartment and the second compartment, wherein the dispensing head is secured to the body by a welding operation, and wherein the sealed compartment is capable of deformation following the welding operation.

12. A heat exchanger for receiving a fluid, comprising:

a body, comprising:

an inlet side;

an outlet side;

a first compartment through which the fluid can flow;

a second compartment through which the fluid can flow;

a first sealed compartment comprising a first closure bar positioned therein, wherein the first closure bar is positioned a first distance from the inlet side;

a second sealed compartment comprising a second closure bar positioned therein, wherein the second closure bar is positioned a second distance from the inlet side, and wherein the first distance is different than the second distance; and a separating wall disposed between the first compartment and the second compartment that hermetically separates the first compartment and the second compartment from one another; and a collection head for collecting the fluid exiting the first compartment and the second compartment, wherein the collection head is secured to the body by a welding operation, and wherein the first sealed compartment is capable of deformation following the welding operation.

13. The heat exchanger according to claim 1, wherein the end closure bar comprises a bevel facing the dispensing head.

14. The heat exchanger according to claim 1, wherein the blocked portion of the end compartment comprises wave plates therein.

15. The heat exchanger according to claim 1, wherein the body comprises an inlet side and an outlet side opposite the inlet side, and wherein the end closure bar is aligned with the inlet side and does not extend to the outlet side.

16. The heat exchanger according to claim 11, wherein the second compartment is positioned intermediate the sealed compartment and the first compartment.

17. The heat exchanger according to claim 11, wherein the body comprises an inlet side and an outlet side, wherein the sealed compartment comprises a closure bar positioned intermediate the inlet side and the outlet side, and wherein the closure bar is not positioned adjacent the inlet side or the outlet side.

18. The heat exchanger according to claim 12, further comprising an inlet, wherein the first sealed compartment is positioned closer to the inlet than the second sealed compartment, and wherein the first closure bar is positioned closer to the inlet side than the second closure bar.

19. The heat exchanger according to claim 12, wherein the first closure bar is positioned closer to the inlet side than the second closure bar, and wherein the second closure bar is positioned closer to the outlet side than the first closure bar.

20. The heat exchanger according to claim 12, wherein the body defines a longitudinal axis extending between the inlet side and the outlet side, and wherein the first closure bar and the second closure bar do not overlap longitudinally with respect to the longitudinal axis.

* * * * *